US009506315B2

(12) United States Patent
Connelly

(10) Patent No.: US 9,506,315 B2
(45) Date of Patent: Nov. 29, 2016

(54) OPEN-HOLE PACKER

(71) Applicant: TEAM OIL TOOLS, LP, The Woodlands, TX (US)

(72) Inventor: Wayland Dale Connelly, Montgomery, TX (US)

(73) Assignee: TEAM OIL TOOLS, LP, The Woodlands, TX (US)

( * ) Notice: Subject to any disclaimer, the term of this patent is extended or adjusted under 35 U.S.C. 154(b) by 0 days.

(21) Appl. No.: 14/640,166

(22) Filed: Mar. 6, 2015

(65) Prior Publication Data

US 2016/0258244 A1 Sep. 8, 2016

(51) Int. Cl.
*E21B 33/12* (2006.01)

(52) U.S. Cl.
CPC ..... *E21B 33/1208* (2013.01)

(58) Field of Classification Search
CPC ..... E21B 33/12; E21B 33/1208
See application file for complete search history.

(56) References Cited

U.S. PATENT DOCUMENTS 4,149,594 A * 4/1979 Evans ..... E21B 33/1294 166/133
4,720,113 A * 1/1988 Hertz, Jr. ..... F16J 15/20 277/342
5,046,557 A * 9/1991 Manderscheid .... E21B 33/1295 166/120
5,433,275 A * 7/1995 Melenyzer ..... E21B 17/06 166/117.6
5,775,429 A * 7/1998 Arizmendi ..... E21B 33/128 166/196
6,041,858 A * 3/2000 Arizmendi ..... E21B 33/1208 166/187
2007/0163777 A1* 7/2007 Murray ..... E21B 33/1216 166/179
2010/0101776 A1* 4/2010 Atkins ..... E21B 33/1208 166/121
2011/0193291 A1* 8/2011 Schilte ..... E21B 33/1208 277/314
2013/0146311 A1* 6/2013 Hathcoat ..... E21B 23/01 166/387
2013/0175035 A1* 7/2013 Lee ..... E21B 33/12 166/298
2016/0024859 A1* 1/2016 Farmer ..... E21B 17/08 166/255.1
2016/0053591 A1* 2/2016 Hallundbæk ..... E21B 43/108 166/118
2016/0060998 A1* 3/2016 Hiorth ..... E21B 33/12 166/192

FOREIGN PATENT DOCUMENTS

DK WO 2014086962 A2 * 6/2014 ..... E21B 43/103

* cited by examiner

*Primary Examiner* — Matthew R Buck
*Assistant Examiner* — Aaron Lembo
(74) *Attorney, Agent, or Firm* — MH2 Technology Law Group, LLP

(57) ABSTRACT

A downhole tool, packer, and method for manufacturing a downhole tool. The downhole tool includes a first sealing element, and a second sealing element spaced axially apart from the first sealing element. The downhole tool also includes a back-up member disposed at least partially around the first sealing element and the second sealing element, and positioned axially therebetween. The back-up member includes one or more anti-swab features that are configured to prevent migration of fluid at least between the first sealing element and the back-up member.

22 Claims, 7 Drawing Sheets

OPEN-HOLE PACKER

BACKGROUND

In the oilfield industry, various downhole tools (e.g., packers, bridge plugs, frac plugs) may be used to isolate sections of a wellbore. Such downhole tools may include a sealing element, which is generally made of rubber. The sealing element may initially be in a contracted configuration, allowing the downhole tool to be run into the wellbore without the sealing element scraping against the wellbore or any other surrounding tubular.

Upon reaching a desired location, such as an interface between two formation zones, the tool may be set. As part of the setting process, the sealing element may be expanded so as to seal with the wellbore wall (in the case of an open-hole tool) or with another surrounding tubular.

There are many different ways to expand the sealing element of a downhole tool. They include inflation, swelling, and mechanical setting, with there being many different designs for each. In particular, mechanical setting often involves squeezing the sealing element axially between two collars, so as to force the sealing element to deform and expand outwards. This may reliably set the tool, without have to employ fluids in the downhole environment to achieve setting.

One type of downhole tool is a packer, which generally isolates one section of a well annulus from another. Some packers are tailored for use in open-hole environments, i.e., wellbores and/or sections thereof that do not have a casing, liner, etc. between the packer and the wellbore wall. In these situations, the mechanical setting process may produce challenges. For example, open-hole packers are used in staged fracturing, allowing pressurized fluid to be injected into the annulus between the tubular and the wellbore in a specific zone, thereby fracturing the formation zone. During setting, however, the sealing element itself applies a load on the wellbore wall. This load may be additive with the load applied by the pressurized fluids, such that, when the pressurized fluid is injected, fractures tend to be concentrated near the packer.

SUMMARY

Embodiments of the disclosure may provide a downhole tool. The downhole tool includes a first sealing element, and a second sealing element spaced axially apart from the first sealing element. The downhole tool also includes a back-up member disposed at least partially around the first sealing element and the second sealing element, and positioned axially therebetween. The back-up member includes one or more anti-swab features that are configured to prevent migration of fluid at least between the first sealing element and the back-up member.

Embodiments of the disclosure may also provide a method for manufacturing a downhole tool. The method includes positioning a back-up member, a first sealing element, and a second sealing element at least partially around a mandrel. The back-up member is disposed at least partially around the first and second sealing elements and axially therebetween. The back-up member includes one or more protrusions that engage the first sealing element, the second sealing element, or both. The method further includes positioning a setting assembly around the mandrel. The setting assembly is configured to radially expand the first and second sealing elements. Moreover, at least a portion of the back-up member deflects outward when the sealing elements are radially expanded.

Embodiments of the disclosure may further provide a packer. The packer includes a mandrel defining a bore at least partially axially therethrough, and a first sealing element disposed around the mandrel. The packer also includes a second sealing element disposed around the mandrel and separated axially apart from the first sealing element, and a back-up member disposed around the first and second sealing elements. The back-up ring member includes at least one protrusion received into one or more grooves of the first sealing element, the second sealing element, or both, and a medial rib extending radially inwards between the first and second sealing elements. The packer further includes a setting assembly disposed around the mandrel and configured to expand the first and second sealing elements.

BRIEF DESCRIPTION OF THE DRAWINGS

The present disclosure may best be understood by referring to the following description and accompanying drawings that are used to illustrate one or more embodiments. In the drawings.

DETAILED DESCRIPTION

Figure 1:
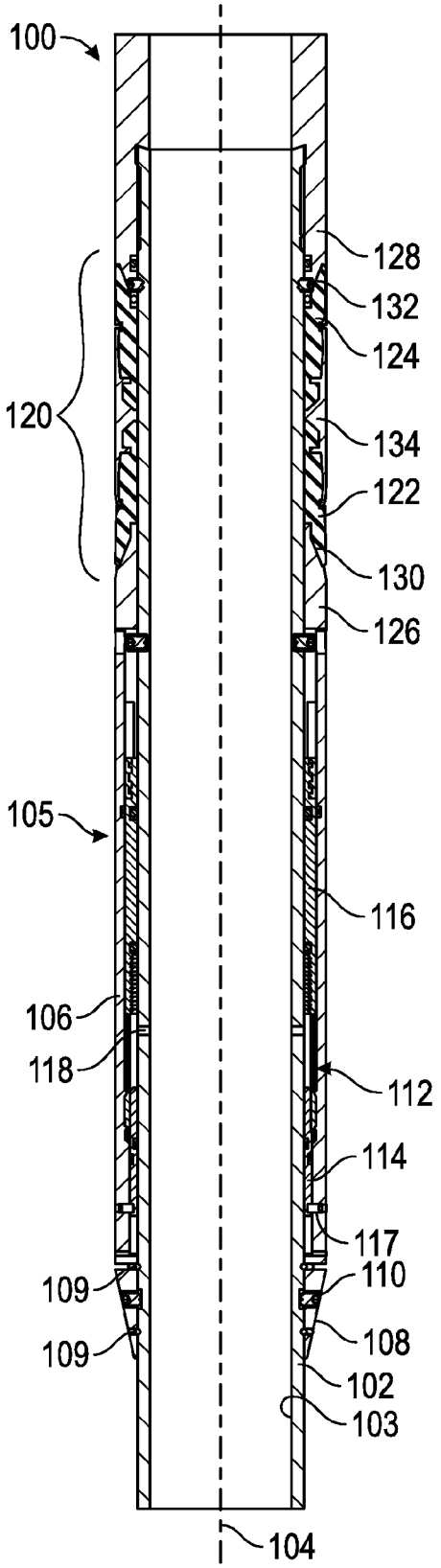
FIG. 1 illustrates a side, cross-sectional view of a downhole tool in a first configuration, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, cross-sectional view of a downhole tool 100 in a first or "run-in" configuration, according to an embodiment. In one example, the downhole tool 100 may be a packer, which may be designed to be connected to a casing string (or another type of oilfield tubular), run into a tubular, and expanded to seal with a surrounding tubular (e.g., a casing, liner, or the wellbore wall itself). In another example, the downhole tool 100 may be a packer intended to be set in an open-hole (uncased) region of a wellbore. However, it will be appreciated that aspects of the present disclosure may be used with a variety of different tools, in cased-hole applications, etc.

The illustrated embodiment of the downhole tool 100 includes a mandrel 102, which may be a generally hollow, cylindrical structure to which one or more surrounding components may be attached. The mandrel 102 may be provided as a single, unitary piece, or may be provided by two or more cylinders or segments that are attached, integrated, or otherwise coupled together. The mandrel 102 may also define a central axis 104. As the term is used herein, "axial" generally refers to a direction parallel to the central axis 104. Further, "radial" refers to a direction in the plane perpendicular to the central axis 104. The mandrel 102 may also define a central bore 103 therein, which may extend axially at least partially (e.g., entirely) therethrough.

The downhole tool 100 may further include a setting assembly 105, which may be or include one or more components received at least partially around the mandrel 102. For example, the downhole tool 100 may also include an outer housing 106 disposed at least partially around the mandrel 102. A first or "downhole" end 108 of the outer housing 106 may converge towards the mandrel 102 and may thus form a generally tapered profile. In an embodiment, the outer housing 106 may be fastened to the mandrel 102 by one or more lock rings 109 and/or one or more set screws 110. For example, the set screws 110 may be received through the tapered, first end 108, but in other embodiments, may be adhered, welded, or otherwise secured in position with respect to the mandrel 102.

In some contexts, "downhole" (e.g., "downhole tool") may refer to a component that is configured to be disposed in the wellbore. In another context, the terms "uphole" and "downhole" may refer to a position closer to the surface of the Earth and a position farther into the wellbore, respectively. Accordingly, these terms may apply regardless of whether a wellbore is deviated, horizontal, or vertical. Similarly, directional terms such as "up," "upper," "down," "lower," "above," "below," "upward," "downward," etc. may be used for the sake of convenience to refer to the illustrated embodiments; however, these terms are intended to refer to the positioning of the elements relative to one another, and not to limit the embodiments to any particular frame of reference or perspective.

Returning to FIG. 1, at least a portion of the outer housing 106 may be spaced radially apart from the mandrel 102, resulting in an annulus 112 being defined therebetween. A first piston 114 and a second piston 116 may be disposed within the annulus 112, at least partially around the mandrel 102. Further, a pressure port 118 may extend radially through the mandrel 102, and may provide a flowpath for communicating pressure from the bore 103 to the annulus 112. The pressure port 118 may be located at a position axially between or on either axial side of the first and second pistons 114, 116.

The first piston 114 may be held in place relative to the mandrel 102 by a shear pin 117 connected with the outer housing 106. In other embodiments, other shear devices, or any other mechanism, adhesives, etc. may be employed to constrain the position of the first piston 114. Furthermore, in some embodiments, a rupture device (e.g., disk) or another flow-control device may additionally or instead be employed to selectively limit and then permit pressure to be applied to the first piston 114, thereby controlling the movement of the first piston 114. The second piston 116 may initially be held in place relative to the mandrel 102 by the first piston 114, as will be explained in greater detail below.

The downhole tool 100 may also include a sealing assembly 120. In an embodiment, the sealing assembly 120 may include one or more, for example, two sealing elements 122, 124. The sealing elements 122, 124 may be made from a rubber, or another elastomer, plastic, or any other material, of any suitable hardness. In some embodiments, the sealing elements 122, 124 may be rubber and may have a hardness of e.g., about 30 durometer, about 40 durometer, or about 50 durometer to about 100 durometer, about 110 durometer, or about 120 durometer. For example, the sealing elements 122, 124 may have a hardness of about 90 durometer. Other hardnesses are contemplated. The sealing elements 122, 124 may or may not have equal hardnesses and/or may be made of two or more materials of different hardnesses.

The sealing assembly 120 may further include a back-up member 134. The back-up member 134 may have a generally cylindrical shape and/or outward appearance; however, the inner diameter thereof may be non-cylindrical, as shown and further described below. The back-up member 134 may be received around at least a portion of the sealing elements 122, 124 and may be disposed axially therebetween as well. Further, the back-up member 134 may be made from a relatively flexible, yet strong, material, such as a metal, an alloy, or the like. In other embodiments, the back-up member 134 may be provided by a fiber-reinforced polymer (e.g., carbon fiber), an elastomer, or the like. In some embodiments, the back-up member 134 may be made of a combination of any such materials.

In order to expand the sealing elements 122, 124, the setting assembly 105 may additionally include a first tapered member 126, which may also be referred to as a setting cone. The setting assembly 105 may further include a second tapered member 128, which may be referred to as (or considered part of) an upper sub. One or both of the first tapered member 126 and second tapered member 128 may be movable relative to the mandrel 102, and the first tapered member 126 and second tapered member 128 may be capable of moving axially toward one another during the setting process. For example, the first tapered member 126 is movable with respect to the mandrel 102 and the second tapered member 128, while the second tapered member 128 is threaded to, or integrally formed with, the mandrel 102 and thus may be generally fixed in position relative thereto.

The first tapered member 126 and the second tapered member 128 may define tapered surfaces 130, 132, respectively, which may face one another and face the sealing elements 122, 124. In defining the tapered surfaces 130, 132, the first and second tapered members 126, 128 may decrease in radial thickness as proceeding axially toward the first and second sealing elements 122, 124, respectively, such that the first and second tapered members 126, 128 act as wedges, driving the first and second sealing elements 122, 124 radially outward during setting, as the first and second tapered members 126, 128 are moved toward one another.

Figure 2:
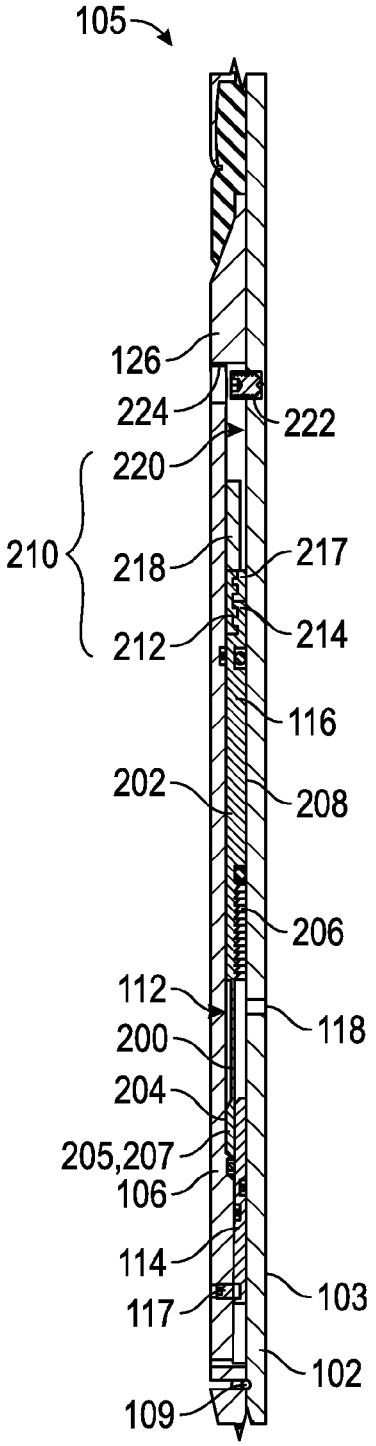
FIG. 2 illustrates an enlarged, cross-sectional view of a portion of the downhole tool, according to an embodiment.

FIG. 2 illustrates an enlarged cross-sectional view of a portion of the downhole tool 100, according to an embodiment. As shown, the first and second pistons 114, 116 may be disposed in the annulus 112 between the outer housing 106 and the mandrel 102. The first and second pistons 114, 116 are axially overlapping during run-in, e.g., at least a portion of the first piston 114 is disposed radially between the mandrel 102 and the second piston 116. In an embodiment, the second piston 116 includes one or more fingers 200 extending from a main body 202. The fingers 200 may be arcuate segments of reduced radial thickness (as compared to a remainder of the second piston 116), and may optionally be separated by slots.

Further, the fingers 200 may each include a protrusion 204 proximal to an end thereof. The protrusion 204 may extend radially outwards. Threads 205 may be defined on the outer surface of the protrusion 204, and may engage threads 207 formed on an inner surface of the outer housing 106. The threads 205, 207 may be acme threads, buttress threads, or any other type of threads, and may be inclined on at least one side, such that an axial force may deflect the fingers 200 (if unconstrained) radially inwards by interaction between the two sets of meshed threads 205, 207. In other embodiments, the protrusion 204 may extend radially inward, the threads 205 thereof may be formed on an inner surface of the protrusions 204 and may engage threads formed on the mandrel 102, and the fingers 200 may be disposed radially between the first piston 114 and the mandrel 102.

In the illustrated embodiment, when the downhole tool 100 is in the run-in configuration, the first piston 114 may be received radially between the mandrel 102 and at least a portion of the fingers 200. Thus, the first piston 114 may prevent the fingers 200 from deflecting radially inwards. Accordingly, the threads 205 of the second piston 116 and the outer housing 106 may be held in engagement, preventing axial displacement of the second piston 116 with respect to the outer housing 106. It will be appreciated that, if the threads 205 on the protrusions 204 mesh with threads (not shown) of the mandrel 102, the first piston 114 may prevent radial-outward deflection of the fingers 200. Moreover, assembly of the first and second pistons 114, 116 within the outer housing 106 may not require deflection of the fingers 200 inward, but may allow the second piston 116 to be threaded into place within the outer housing 106.

The second piston 116 may also be coupled with a lock ring 206. For example, a portion of the main body 202 may have threads that engage threads of the lock ring 206. The lock ring 206, in turn, may have threads or teeth on an inner diameter thereof. The mandrel 102 may have corresponding threads 208, and the meshing between the lock ring 206 and the threads 208 of the mandrel 102 may serve as a one-way ratchet, which may allow movement of the second piston 116 in an uphole direction, but prevent it from reversing.

Figure 3:
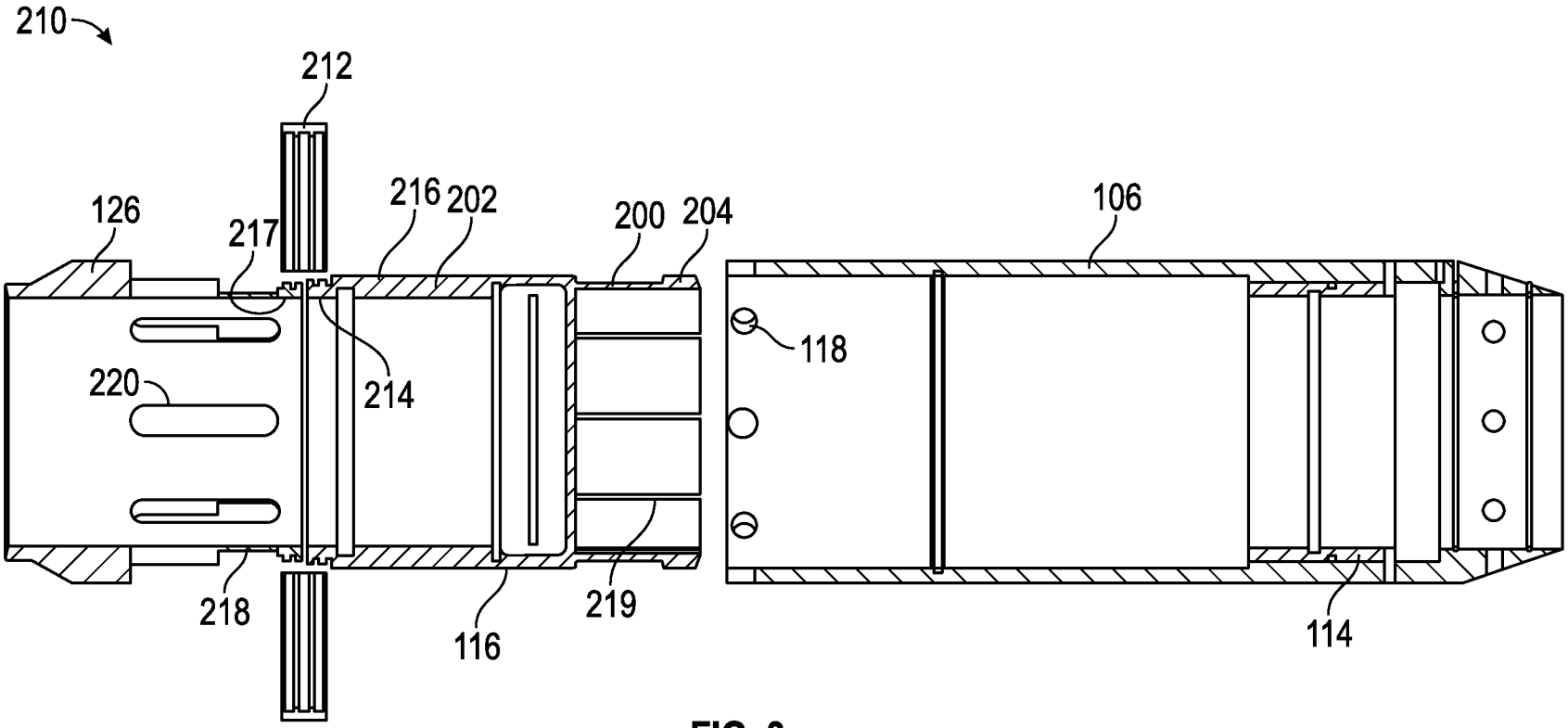
FIG. 3 illustrates an exploded, side view of a portion of a setting assembly and a portion of a connector assembly of the downhole tool, according to an embodiment.

FIG. 3 illustrates an exploded side view of the housing 106 and second piston 116, along with a connector assembly 210, according to an embodiment. Referring now to both FIGS. 2 and 3, in some embodiments, the connector assembly 210 may be an integral piece of the second piston 116, but, in other embodiments, may be one or more additional components attached, coupled, or otherwise connected thereto. As shown, the connector assembly 210 may include a coupler ring 212 received around a second or "downhole" end 214 of the second piston 116 and around a first or "uphole" end 217 of a sleeve 218. The sleeve 218 may engage, be coupled with, or be integral to the first tapered member 126, such that, for example, the first tapered member 126 is movable by movement of the sleeve 218 and the second piston 116.

The sleeve 218 may define one or more slots 220. One or more stops 222 may be received through the slots 220 and coupled with the mandrel 102. The one or more stops 222 may be or include, for example, one or more screws threaded into the mandrel 102 and received through a bore 224 formed in the outer housing 106. In other embodiments, the stop 222 may be provided by a shoulder that is integral with the mandrel, by a collar, and/or by another type of structure or device. Axial translation of the sleeve 218, and thus the stroke length of the second piston 116 and the first tapered member 126, may be limited by the stop 222 disposed in the slot 220. Also visible in FIG. 3 are the aforementioned slots, indicated as reference number 219, which extend axially and separate the fingers 200 apart circumferentially, according to an embodiment.

Figure 4:
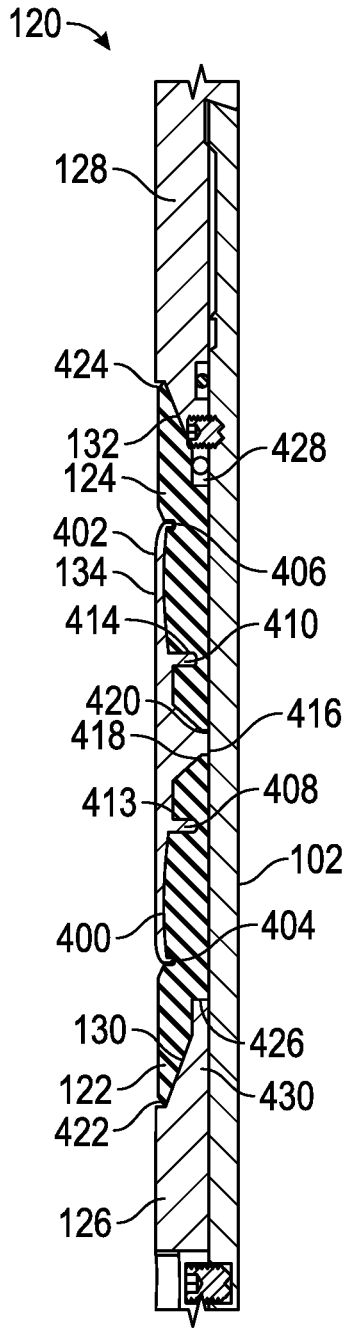
FIG. 4 illustrates an enlarged, cross-sectional view of a portion of the downhole tool, providing a more detailed depiction of a sealing assembly thereof, according to an embodiment.

FIG. 4 illustrates an enlarged, cross-sectional view of a portion of the downhole tool 100, providing a more detailed depiction of the sealing assembly 120, according to an embodiment. The back-up member 134 of the sealing assembly 120 may include one or more hooks. For example, the back-up member 134 may include a lower hook 400 and an upper hook 402. The hooks 400, 402 may each be continuous, forming rings at either axial end of the back-up member 134, or the hooks 400, 402 may be segmented and separated by slots. Further, the hooks 400, 402 may have a radial thickness that is relatively small compared to regions closer to the axial middle of the back-up member 134. The extremities of the hooks 400, 402 may have a J-shape, in an embodiment, and may be at least partially received into holes or grooves 404, 406 formed in the sealing elements 122, 124, respectively.

The back-up member 134 may also include one or more radially-inward extending protrusions, e.g. axially between each of the hooks 400, 402 and the axial middle of the back-up member 134. For example, two protrusions 408, 410 (e.g., ribs) may be included in the back-up member 134. The protrusions 408, 410 may have a rounded inner edge, and may form an interference fit with grooves 413, 414, respectively, formed in the sealing elements 122, 124. Accordingly, the combination of the protrusions 408, 410 and the grooves 413, 414 may act as a pressure barrier, similar to the operation of an O-ring.

The back-up member 134 may also include a medial rib 416 that may extend to a position that is radially proximate to the mandrel 102 and axially between the two sealing elements 122, 124. The medial rib 416 may be spaced slightly apart from the mandrel 102 (e.g., on the order of hundredths or thousandths of an inch) such that, under pressure, rounded ends 418, 420 of the sealing elements 122, 124 may extrude between the mandrel 102 and the medial rib 416. Accordingly, the combination of the medial rib 416 and the ends 418, 420 may also act similar to an O-ring.

The back-up member 134 may thus interact with the sealing elements 122, 124 and thereby provide an anti-swab feature. That is, the back-up member 134 may prevent high-pressure fluids around the exterior of the sealing elements 122, 124 from migrating between the back-up member 134 and the sealing elements 122, 124 to a position that is radially between the mandrel 102 and the sealing elements 122, 124. For example, as proceeding from the first tapered member 126, the hook 400, protrusion 408, and medial rib 416, by interaction with the associated hole or groove 404, groove 413, and end 418 of the sealing element 122 may be capable of resisting a particular fluid pressure in fluid between the back-up member 134 and the sealing element 122. The hook 402, protrusion 410, and medial rib 416 may similarly interact with the sealing element 124.

In an embodiment, the first tapered member 126 and the second tapered member 128 may also include retaining lips 422, 424 respectively, e.g., toward the radial-outside of the tapered surfaces 130, 132, respectively. These retaining lips 422, 424 may provide generally smooth transitions between the first tapered member 126 and the second tapered member 128, respectively, and may serve to protect and retain the sealing elements 122, 124 during run-in, for example.

In addition, the sealing elements 122, 124 may be undercut, each defining a shoulder 426, 428 that faces the proximal one of the tapered surfaces 130, 132. The shoulders 426, 428 may be proximal to an inner diameter of the sealing elements 122, 124. In an embodiment, the tapered surface 130 of the first tapered member 126 may not extend to the inner diameter of the first tapered member 126, although, in some embodiments, it may. In the illustrated embodiment, the tapered surface 130 may terminate at an inner shoulder 430 of the first tapered member 126, proximal to (e.g., extending from) the inner diameter thereof. The inner shoulder 430 may be sized to be received into engagement with the shoulder 426 of the first sealing element 122. The tapered surface 132 of the second tapered member 128 may omit such an inner shoulder, and thus, in some embodiments, an empty space may be defined between the shoulder 428 and the tapered surface 132.

Figure 5:
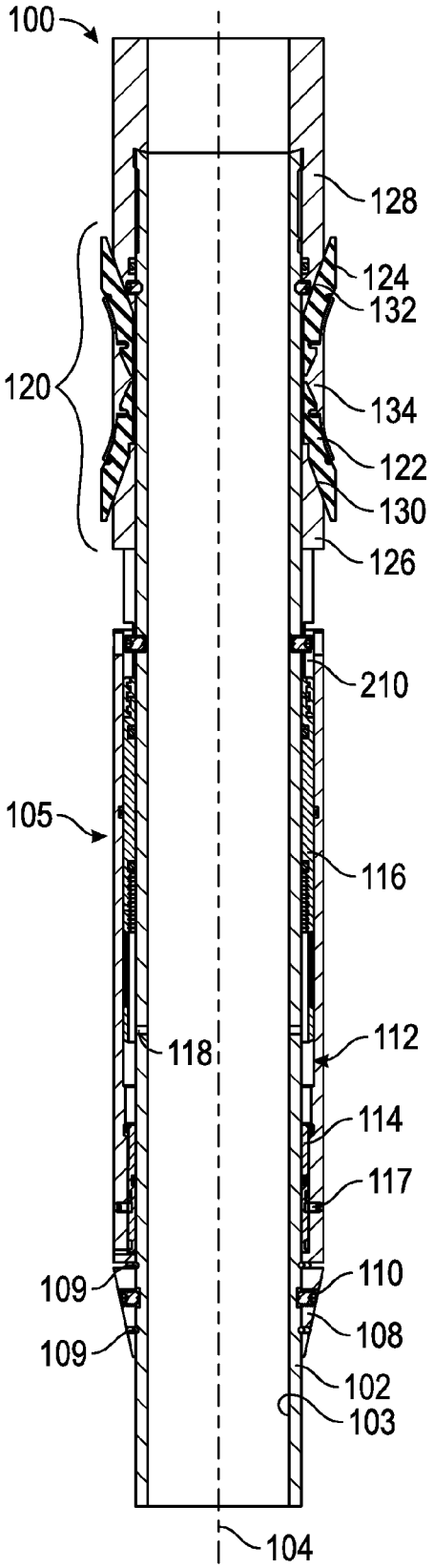
FIG. 5 illustrates a side, cross-sectional view of the downhole tool in a second configuration, according to an embodiment.

FIG. 5 illustrates a side, cross-sectional view of the downhole tool 100 in a second or "set" configuration, according to an embodiment. As shown, in this configuration, the sealing elements 122, 124 have expanded. This is a result of the first tapered member 126 having moved uphole relative to the second tapered member 128. To move the first tapered member 126, pressure is supplied (e.g., using one or more pumps located at the surface or in the wellbore) to the bore 103.

Figure 6A:
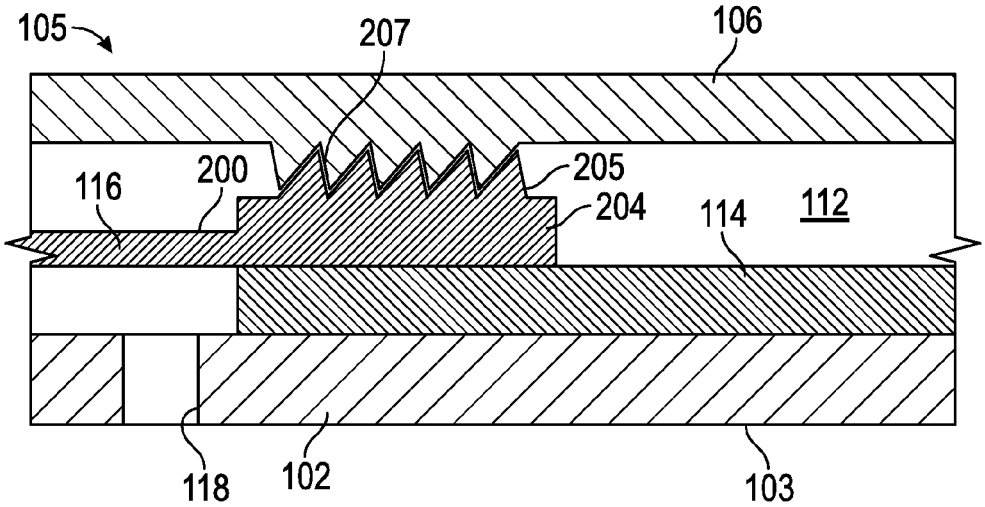
FIGS. 6A and 6B illustrate enlarged views of a portion of a setting assembly of the downhole tool, according to an embodiment.
Figure 6B:
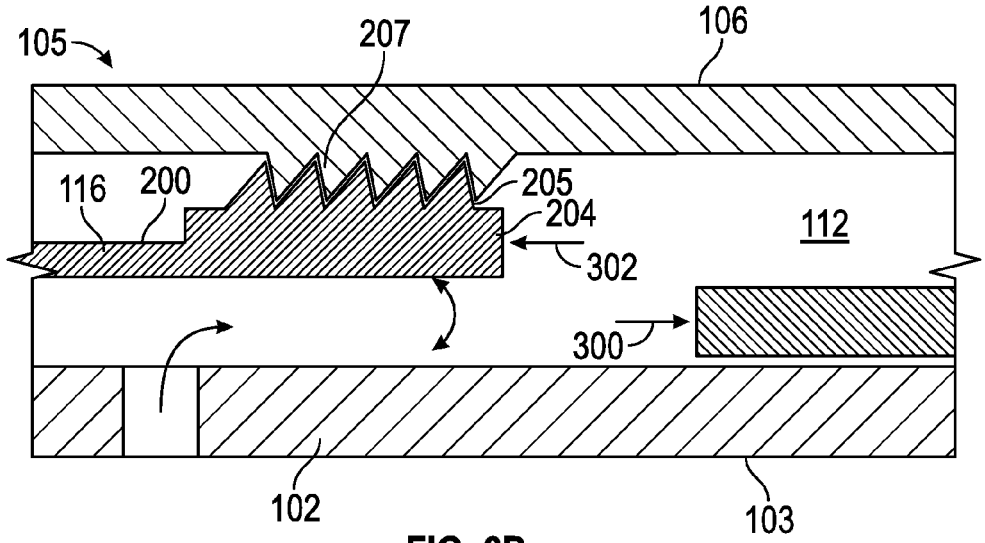

FIGS. 6A and 6B illustrate enlarged views of a portion of the setting assembly 105, specifically the interaction of the first and second pistons 114, 116 with the outer housing 106 and the mandrel 102, according to an embodiment. The components of the downhole tool 100 illustrated in FIGS. 6A and 6B may be exaggerated for purposes of illustration. In the first configuration of the downhole tool 100, as shown in FIG. 6A, the threads 205, 207 are meshed. The fingers 200 of the second piston 116, which may be flexible, are prevented from flexing by the first piston 114 being disposed radially between the mandrel 102 and the second piston 116. Thus, the meshed threads 205, 207 prevent the second piston 116 from moving with respect to the mandrel 102.

In the second configuration of the downhole tool 100, as shown in FIG. 6B, pressure is communicated from the bore 103, through the pressure ports 118, and to the annulus 112. The pressure applies an axially directed force 300 on the first piston 114, which may eventually overcome holding forces applied by the shear pin 117 (e.g., FIG. 1) and may cause the first piston 114 to move in a first axial direction, away from engagement with the second piston 116.

With the first piston 114 no longer disposed within the fingers 200 of the second piston 116, the fingers 200 are free to deflect. The pressure communicated through the pressure port 118 may supply sufficient axial force for the engagement between the threads 205 on the protrusions 204 and the threads 207 of the outer housing 106 to apply a radial-inward force on the protrusions 204. This radial inward force may result in the fingers 200 deflecting radially inwards, as the threads 205 move out of engagement with the threads 207 (e.g., several times as the threads 205 jump out of engagement temporarily and move along the threads 207), and eventually allow the second piston 116 to move downhole.

Figure 6C:
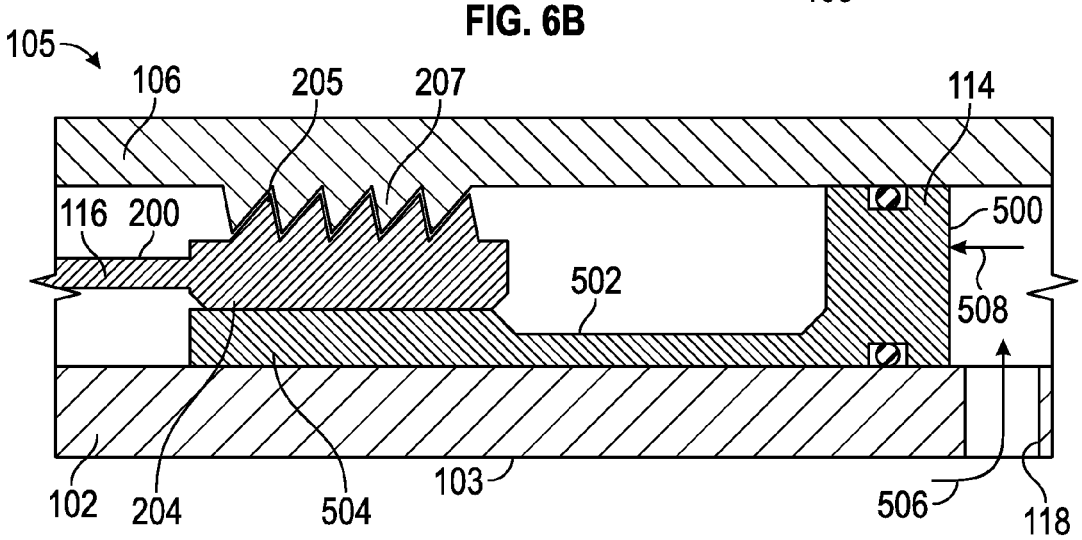
FIG. 6C illustrates an enlarged view of a portion of another setting assembly of the downhole too, according to an embodiment.

FIG. 6C illustrates an enlarged view of another embodiment of the setting assembly 105, according to an embodiment. In this embodiment, the actuation or setting of the downhole tool 100 may result in the first and second pistons 114, 116 moving in the same axial direction. For example, the axial direction may be uphole (left in FIG. 6C). In such an embodiment, as shown, the port 118 may be positioned downhole of the first piston 114, so as to apply a force thereon tending to push the first piston 114 and the second piston 116 in the uphole direction, as will be explained below.

The second sleeve 116 may be formed generally similarly to the setting sleeve 116 of FIGS. 6A and 6B, and thus may include fingers 200 with a protrusion 204 that has threads 205 that engage threads 207 on the outer housing 106. However, as mentioned above, the setting assembly 105 may be configured such that the threads 205 may instead engage threads formed on the mandrel 102.

The first piston 114 may include a body 500, a recessed portion 502, and a protrusion 504. In the first configuration, with the first piston 114 preventing the second piston 116 disengaging from the threads 207, the protrusion 504 of the first piston 114 may be disposed radially between the protrusion 204 of the second piston 116. This may prevent the fingers 200 from deflecting.

A predetermined amount of pressure may be applied to the bore 103, through the port 118, and onto the body 500 of the first piston 114, as schematically represented by arrow 506. This pressure may be applied to the surface area of the body 500, generating an axially-directed force 508 that may overcome one or more components (if present) that maintain the position of the first piston 114, such as a shear pin or screw, adhesive, etc. In some embodiments, a rupture disk may be positioned in the port 118, in addition to or in lieu of such a shear pin.

The first piston 114 may thus slide uphole (left, as shown) in response to the force 508. Eventually, the protrusion 504 of the first piston 114 may move past the protrusion 204 of the second piston 116. At that point, the protrusion 204 of the second piston 116 may be axially aligned with the recessed portion 502, and may thus have radial space in which to move out of engagement with the threads 207. Further, the continued application of the force 508 may be transmitted to the second piston 116 via the body 500, or a pressure port, either through the body 500 or uphole of the first piston 114 (e.g., engaging the body 202 thereof, FIG. 3) and in communication with the bore 103.

Figure 7:
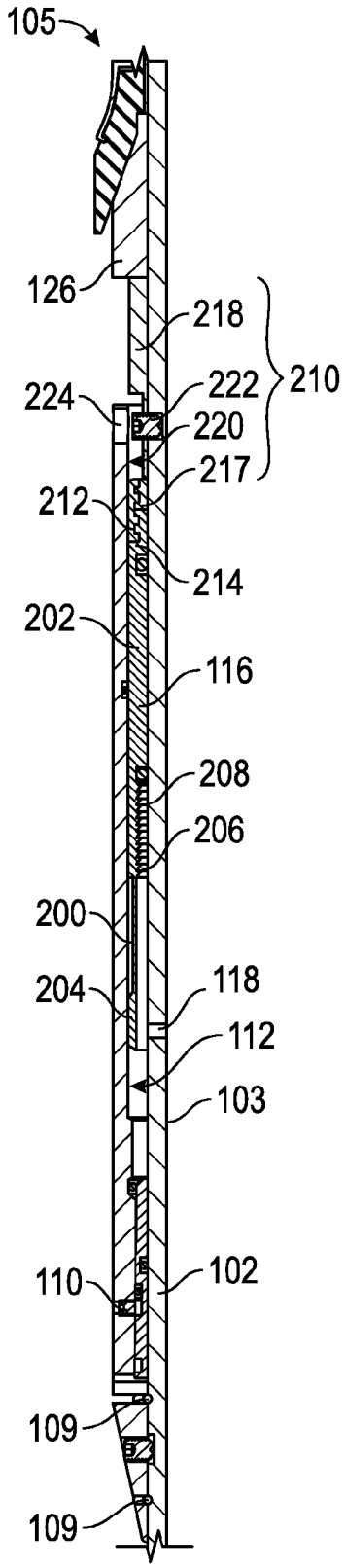
FIG. 7 illustrates a side, cross-sectional view the sealing assembly when the downhole tool is in the set configuration, according to an embodiment.

FIG. 7 illustrates a side, cross-sectional view of the setting assembly 105, according to an embodiment. As the second piston 116 is moved downhole, the lock ring 206 may move along with the second piston 116 and may engage the threads 208 of the mandrel 102, preventing the second piston 116 from moving back downhole, even after the pressure is relieved. The movement of the second piston 116, relative to the mandrel 102, may be transmitted to the first tapered member 126 via the connector assembly 210 described above.

Figure 8:
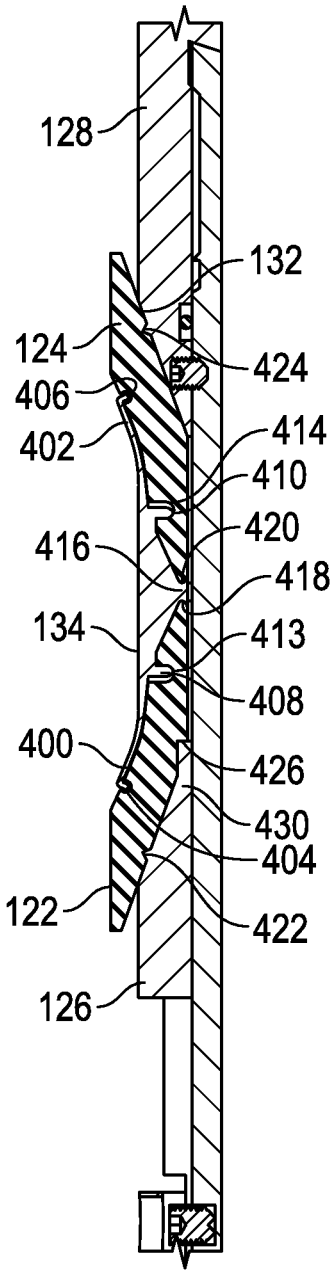
FIG. 8 illustrates a cross-sectional view of another embodiment of the downhole tool, specifically, a connector assembly thereof, according to an embodiment.

With continuing reference to FIG. 7, FIG. 8 illustrates a side, cross-sectional view the sealing assembly 120 when the downhole tool 100 is in the second configuration, according to an embodiment. In the set configuration, the sealing elements 122, 124 have expanded radially outward. When there is a surrounding tubular or wellbore wall, the sealing elements 122, 124 may engage the surrounding tubular or wellbore wall. Further, radially outside of the first tapered member 126 and the second tapered member 128, the sealing elements 122, 124 may be generally unconstrained by external structures from axial extrusion. Thus, the force with which the sealing elements 122, 124 form a seal with the surrounding tubular or wellbore may be determined at least partially by the hardness of the material used to make the sealing elements 122, 124. This may, for example, avoid overloading the surrounding tubular and/or wellbore wall, which may otherwise be experienced if the sealing elements 122, 124 were axially constrained from extruding.

The hooks 400, 402 of the back-up member 134 may deflect (e.g., bend) as the sealing elements 122, 124 extend outwards. The hooks 400, 402 may thus serve to guide the deflection of the sealing elements 122, 124 and may protect the sealing elements 122, 124 from foreign bodies in the wellbore. In other embodiments, the hooks 400, 402 may provide minimal or no restraining or guiding force on the sealing elements 122, 124, with the function of protecting the sealing elements 122, 124 during run-in having already been completed. Further, any one or more of the hooks 400, 402, protrusions 408, 410, and medial rib 416, interacting with the holes 404, 406, grooves 413, 414, and ends 418, 420 may continue to provide the anti-swab feature described above.

As also mentioned above, the shoulder 430 on the first tapered member 126, which may, in some embodiments, be omitted from the second tapered member 128, may assist in balancing the setting process. Since the first tapered member 126 is, in this embodiment, the part that moves relative to the mandrel 102 during the setting process, the setting force reaches the upper sealing element 124 after transmission thereto via the lower sealing element 122. To avoid the lower sealing element 122 over-expanding prior to the upper sealing element 124 expanding sufficiently, the engagement between the shoulder 430 and the shoulder 426 may delay the expansion of the lower sealing element 122. During this delay, force may be transmitted to the lower sealing element 124 while the upper sealing element 122 is substantially prevented from expanding by interaction with the shoulder 430. At a certain point, the setting force of the first tapered member 126 may cause the lower sealing element 122 to deflect and move out of engagement with the shoulder 430, whereupon the lower sealing element 122 may expand radially outwards as the tapered surface 130 of the first tapered member 126 is driven axially downward.

Figure 9:
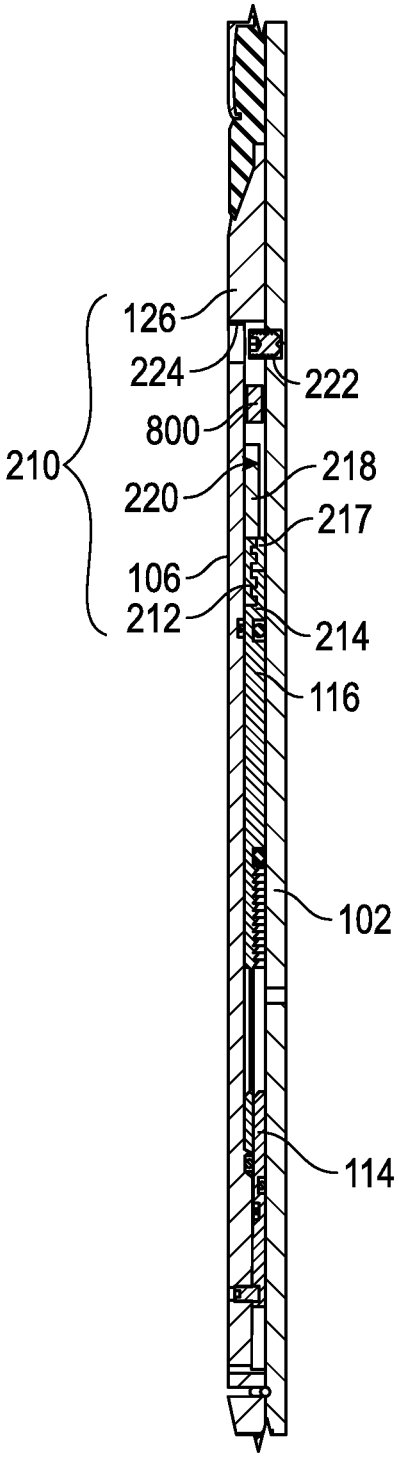
FIG. 9 illustrates a partial, cross-sectional view of another embodiment of the downhole tool, specifically, a connector assembly thereof, according to an embodiment.

FIG. 9 illustrates a cross-sectional view of another embodiment of the downhole tool 100, specifically, the connector assembly 210, according to an embodiment. The connector assembly 210 of FIG. 9 incorporates a stroke-limiting feature, which may prevent over-compressing the sealing elements 122, 124 and/or may otherwise limit the length that the sleeve 218, and thus the second piston 116 and the first tapered member 126, may travel relative to the mandrel 102. As illustrated, in an embodiment, the stroke-limiting feature may include one or more spacers 800, which may be rings, blocks, etc., in one or more of the slots 220. The spacers 800 may be disposed on an downhole side of the stop 222, such that the sleeve 218 engages the spacers 800, which in turn abut the stop 222, and stop the stroke of the second piston 116.

In another embodiment, the stroke-limiting feature may be provided by adjusting the position of the stop 222. For example, multiple bores in the mandrel 102 and multiple aligning bores (e.g., multiple bores 224) may be formed in the outer housing 106. The multiple bores may be positioned at a variety of axial positions, which may allow the stop 222 position to be determined according to the desired stroke length of the second piston 116. In other embodiments, an axially-elongated coupler ring 212 and/or a spacer between the ends 214, 217 may be provided, such that the sleeve 218 engages the stop 222 earlier that otherwise. In various embodiments, two or more of these structures may be provided as part of the stroke-limiting feature.

Figure 10:
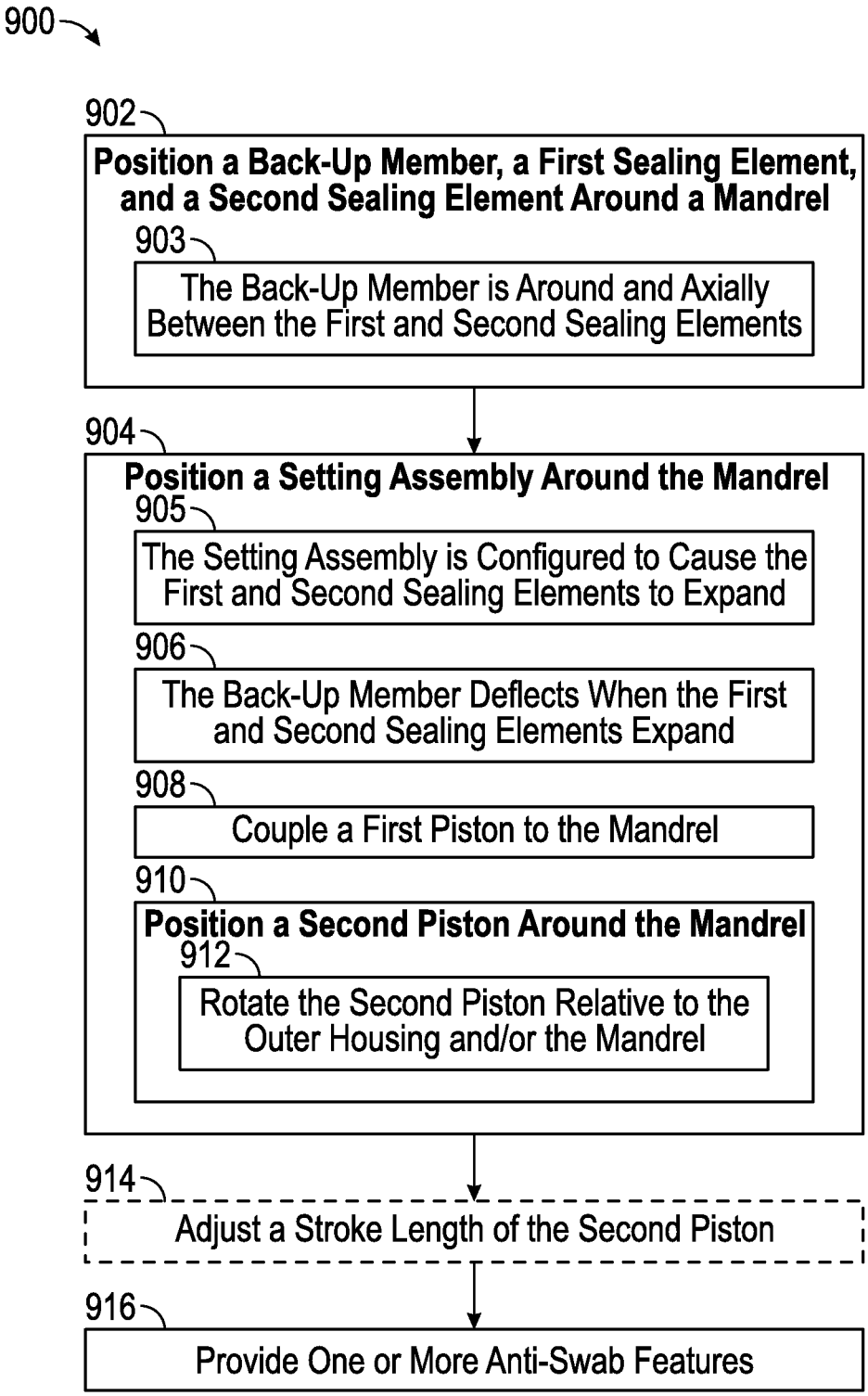
FIG. 10 illustrates a flowchart of a method for assembling a downhole tool, according to an embodiment.

FIG. 10 illustrates a flowchart of a method 900 for assembling a downhole tool, according to an embodiment. In an embodiment, performing the method 900 may result in an embodiment of the downhole tool 100 as shown in one or more of FIGS. 1-8 and described above, and, accordingly, will be described herein with reference thereto. However, other embodiments of the method 900 may result in other downhole tools, and thus the method 900 is not limited to any particular structure, unless otherwise stated herein.

With additional reference to FIGS. 1-9, the method 900 may include positioning a back-up member 134, a first sealing element 122, and a second sealing element 124 at least partially around a mandrel 102, as at 902. The back-up member 134 may be disposed at least partially around a radial outside of the first and second sealing elements 122, 124 and axially therebetween, as indicated at 903. For example, a medial rib 216 of the back-up member 134 may be disposed axially between the first and second sealing elements 122, 124.

The method 900 may also include positioning a setting assembly 105 at least partially around the mandrel 102, as at 904. The setting assembly 105 may be configured to axially compress and radially expand the first and second sealing elements 122, 124, as indicated at 905, e.g., in response to an increased fluid pressure in a bore 103 of the mandrel 102. Further, at least a portion of the back-up member 134 deflects outward when the sealing elements 122, 124 are radially expanded, as indicated at 906.

In an embodiment, positioning the setting assembly 105 at 904 may include coupling an outer housing 106 to the mandrel 102, as at 908. The outer housing 106 may be spaced radially apart from the mandrel 102 such that an annulus 112 is defined between the outer housing 106 and the mandrel 102.

Positioning the setting assembly 105 at 904 may also include coupling a first piston 114 to the mandrel 102, as at 910. Further, the first piston 114 may be disposed in the annulus. Positioning the setting assembly 105 at 904 may also include positioning a second piston 116 at least partially in the annulus 112, as at 912, whether before, during, or after positioning the first piston 114. The first piston 114 may axially overlap at least a portion of the second piston 116, at least when the downhole tool 100 is in a first configuration (e.g., FIG. 1). More particularly, when the downhole tool 100 is in the first configuration, the first piston 114 may prevent radial deflection of at least a portion of the second piston 116. In a second configuration (e.g., FIG. 5) of the downhole tool 100, the first piston 114 may not axially overlap the second piston 116 and may thus not prevent radial deflection of the second piston 116.

In an embodiment, positioning the second piston 116 at 912 includes rotating the second piston 116 relative to the outer housing 106, as at 914. For example, the second piston 116 may include a plurality of radially deflectable fingers 200, which may be circumferentially separated from one another by slots 219 and may have a reduced diameter in comparison to the remainder of the second piston 116. The fingers 200 may also define protrusions 204 proximal the ends thereof, with threads 205 being formed on an outer diameter of protrusions 204. The threads of the protrusions 204 may mesh with threads 207 of the outer housing 106 by rotation of the second piston at 914. The fingers 200 may be axially overlapped with the first piston 114, e.g. disposed radially between the outer housing 106 and the first piston 114, such that the first piston 114 prevents deflection of the fingers 200 and maintains the meshing of the threads 205, 207, when the downhole tool 100 is in the first configuration.

In an embodiment, the method 900 may further include forming one or more ports in the mandrel 102, with the ports being in communication with the annulus 112 at a position axially between the first and second pistons 114, 116 (when the first and second pistons 114, 116 are present). Accordingly, the first and second pistons 114, 116 may be configured to move in opposite axial directions, and thus move the downhole tool 100 from the first configuration to the second configuration upon application of a predetermined pressure in a bore 103 of the mandrel 102.

In an embodiment, positioning the setting assembly 105 at 904 may include receiving a first tapered member 126 of the setting assembly 105 axially adjacent to the first sealing element 122 and at least partially radially between the mandrel 102 and the first sealing element 122. The first tapered member 126 being movable relative to the mandrel 102. Positioning the setting assembly 105 at 904 may also include receiving a second tapered member 128 of the setting assembly 105 axially adjacent to the second sealing element 124 and at least partially radially between the mandrel 102 and the second sealing element 124. Positioning the setting assembly 105 may further include connecting the second piston 116 with the first tapered member 126, such that the first tapered member 126 is movable relative to the mandrel 102 by movement of the second piston 116. Such "connecting" may include integral forming, welding, fastening, or any other connection, whether direct or via one or more intermediate structures.

In an embodiment, the first sealing element 122 includes a shoulder 426 on an inner radial surface thereof. Further, the first tapered member 126 includes a shoulder 430. Positioning the setting assembly 105 at 904 may include disposing the shoulder 430 of the first tapered member 126 against the shoulder 426 of the first sealing element 122.

In an embodiment, the method 900 may optionally include adjusting a stroke length of the second piston 116 from a first distance to a second distance that is different from the first distance, as at 916. Such adjustment may be accomplished, for example, by providing one or more spacers 700, by providing for an adjustable placement of the stop 222, and/or the like.

Further, the method 900 may include providing one or more anti-swab features between the back-up member 134 and at least one of the first sealing element 122 and the second sealing element 124, as at 918. For example, the hooks 400, 402, protrusions 408, 410, and/or the medial rib 416 may interface with holes 404, 406, grooves 413, 414, and/or ends 418, 420 of the first and second sealing elements 122, 124, so as to prevent fluid from migrating between the back-up member 134 and the sealing elements 122, 124 to a position radially between the sealing elements 122, 124 and the mandrel 102.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a first sealing element;

a second sealing element spaced axially apart from the first sealing element; and a back-up member disposed at least partially around the first sealing element and the second sealing element, and positioned axially therebetween, wherein the back-up member comprises one or more anti-swab features that are configured to prevent migration of fluid at least between the first sealing element and the back-up member, wherein the one or more anti-swab features comprise at least one protrusion extending inwards and received into at least one groove defined in the first sealing element.

2. The downhole tool of claim 1, wherein, when the first and second sealing elements are expanded, at least a portion of the first sealing element and the second sealing element are configured to engage a wellbore wall or a surrounding tubular, and the first sealing element and second sealing elements are each free to extrude in at least one axial direction.

3. A downhole tool, comprising:

a first sealing element;

a second sealing element spaced axially apart from the first sealing element; and a back-up member disposed at least partially around the first sealing element and the second sealing element, and positioned axially therebetween, wherein the back-up member comprises one or more anti-swab features that are configured to prevent migration of fluid at least between the first sealing element and the back-up member, wherein the one or more anti-swab features comprise at least one hook at an axial end of the back-up member, wherein the at least one hook is received into a hole or groove defined in the first sealing element.

4. A downhole tool, comprising:

a first sealing element;

a second sealing element spaced axially apart from the first sealing element;

a back-up member disposed at least partially around the first sealing element and the second sealing element, and positioned axially therebetween, wherein the back-up member comprises one or more anti-swab features that are configured to prevent migration of fluid at least between the first sealing element and the back-up member; and a mandrel around which the first sealing element, the second sealing element, and the back-up member are positioned, wherein the one or more anti-swab features comprise a medial rib of the back-up member, the medial rib being positioned axially between the first and second sealing elements, wherein an end of the first sealing element is configured to extrude between the mandrel and the medial rib to form a seal therebetween.

5. The downhole tool of claim 1, further comprising:

a mandrel around which the first sealing element, the second sealing element, and the back-up member are positioned; and a first tapered member positioned around the mandrel and movable with respect to the mandrel, the first tapered member being positioned adjacent to the first sealing member, wherein the first tapered member comprises a shoulder proximal to an inner diameter hereof, and wherein the first sealing element comprises a shoulder proximal to a radial inside thereof, the shoulder of the first tapered member engaging the shoulder of the first sealing element, to delay an expansion of the first sealing element.

6. A downhole tool, comprising:

a first sealing element;

a second sealing element spaced axially apart from the first sealing element; and a back-up member disposed at least partially around the first sealing element and the second sealing element, and positioned axially therebetween, wherein the back-up member comprises one or more anti-swab features that are configured to prevent migration of fluid at least between the first sealing element and the back-up member;

a mandrel around which the first sealing element, the second sealing element, and the back-up member are positioned;

a first tapered member positioned around the mandrel and movable with respect to the mandrel, the first tapered member being positioned adjacent to the first sealing member, wherein the first tapered member comprises a shoulder proximal to an inner diameter thereof, and wherein the first sealing element comprises a shoulder proximal to a radial inside thereof, the shoulder of the first tapered member engaging the shoulder of the first sealing element, to delay an expansion of the first sealing element, wherein the mandrel defines a bore extending at least partially axially therethrough and a port extending radially therein;

an outer housing disposed around the mandrel and at least partially spaced radially apart therefrom, such that an annulus is defined between the outer housing and the mandrel, wherein the annulus communicates with the bore via the port;

a first piston disposed in the annulus; and a second piston disposed in the annulus and connected to the first tapered member, wherein, in a first configuration of the downhole tool, the first and second pistons are axially overlapping such that the first piston prevents axial displacement of the second piston with respect to the mandrel, and in a second configuration of the downhole tool, the first and second pistons are spaced axially apart.

7. The downhole tool of claim 6, wherein:

the second piston comprises a plurality of fingers having threads and defines a plurality of slots, the plurality of fingers being separated circumferentially apart by the plurality of slots;

the outer housing comprises threads that are configured to engage the threads of the fingers; and in the first configuration, the plurality of fingers are prevented from deflecting by the first piston, and in the second configuration, the plurality of fingers are deflectable radially inwards so as to move the threads thereof out of engagement with the threads of the outer housing upon application of an axial force.

8. The downhole tool of claim 7, further comprising a stop coupled with the mandrel and configured to limit a stroke length of the second piston.

9. The downhole tool of claim 8, further comprising a spacer disposed adjacent to the stop and configured to further limit the stroke length of the second piston.

10. A method for manufacturing a downhole tool, comprising:

positioning a back-up member, a first sealing element, and a second sealing element at least partially around a mandrel, wherein the back-up member is disposed at least partially around the first and second sealing elements and axially therebetween, and wherein the back-up member comprises one or more protrusions that engage the first sealing element, the second sealing element, or both; and positioning a setting assembly around the mandrel, wherein the setting assembly is configured to radially expand the first and second sealing elements, and wherein at least a portion of the back-up member deflects outward when the sealing elements are radially expanded, wherein positioning the setting assembly comprises:

coupling an outer housing to the mandrel, wherein a portion of the outer housing is spaced radially apart from the mandrel such that an annulus is defined between the outer housing and the mandrel;

coupling a first piston to the mandrel, the first piston being disposed in the annulus; and positioning a second piston at least partially in the annulus, the first piston axially overlapping at least a portion of the second piston, wherein, in a first configuration of the downhole tool, the first piston prevents radial deflection of at least a portion of the second piston, and in a second configuration of the downhole tool, the first piston does not prevent radial deflection of the second piston.

11. The method of claim 10, wherein the protrusions are configured to limit extrusion of the sealing element in at least one axial direction.

12. The method of claim 10, wherein:

the second piston comprises fingers defining protrusions;

positioning the second piston comprises rotating the second piston relative to the outer housing, without radially compressing the second piston, such that threads of the protrusions of the fingers mesh with threads of the outer housing; and when the downhole tool is in the first configuration, the first piston prevents the fingers from deflecting and maintains the threads of the protrusions in engagement with the threads of the outer housing.

13. The method of claim 10, wherein the downhole tool is configured to move from the first configuration to the second configuration upon application of a predetermined pressure in a bore of the mandrel.

14. The method of claim 13, wherein, upon application of the predetermined pressure, the first piston is configured to move in a first axial direction and the second piston is configured to move in a second axial direction, the first and second axial directions being opposite.

15. The method of claim 10, wherein positioning the setting assembly comprises:

receiving a first tapered member of the setting assembly axially adjacent to the first sealing element and at least partially radially between the mandrel and the first sealing element, wherein the first tapered member is fixed to the mandrel; and receiving a second tapered member of the setting assembly axially adjacent to the second sealing element and at least partially radially between the mandrel and the second sealing element; and connecting the second piston with the second tapered member, such that the second tapered member is movable relative to the mandrel by movement of the second piston.

16. The method of claim 15, wherein the first tapered member comprises a shoulder proximal to an inner diameter thereof, wherein the first sealing element comprises a shoulder, and wherein positioning the setting assembly comprises disposing the shoulder of the first tapered member against the shoulder of the first sealing element.

17. The method of claim 10, further comprising adjusting a stroke length of the second piston from a first distance to a second distance that is different from the first distance.

18. A packer, comprising:

a mandrel defining a bore at least partially axially therethrough;

a first sealing element disposed around the mandrel;

a second sealing element disposed around the mandrel and separated axially apart from the first sealing element;

a back-up member disposed around the first and second sealing elements, the back-up member comprising at least one protrusion received into one or more grooves of the first sealing element, the second sealing element, or both, and a medial rib extending radially inwards between the first and second sealing elements; and a setting assembly disposed around the mandrel and configured to expand the first and second sealing elements.

19. The packer of claim 18, wherein the setting assembly comprises:

a first tapered member having a tapered surface that engages a reverse-tapered surface of the first sealing element; and a second tapered member having a tapered surface that engages a reverse-tapered surface of the second sealing element.

20. The packer of claim 19, wherein the setting assembly further comprises:

an outer housing disposed around the mandrel and defining an annulus, the outer housing defining threads on an inner surface thereof;

a first piston disposed at least partially in the annulus; and a second piston disposed at least partially in the annulus, connected with the first tapered member such that movement of the second piston causes movement of the first tapered member, and comprising a plurality of fingers defining threads thereon, wherein the threads of the second piston are engagable with the threads of the outer housing.

21. The packer of claim 20, wherein:

in a first configuration of the packer, at least a portion of the second piston is disposed radially between the second piston and the mandrel, such that the first piston limits a deflection of the plurality of fingers, so as to maintain an engagement between the threads of the plurality of fingers and the threads of the outer housing, and in a second configuration of the packer, the first piston is spaced apart from the second piston, such that the plurality of fingers of the second piston are deflectable radially inwards upon application of an axial force, so as to move the threads of the plurality of fingers out of engagement with the threads of the outer housing.

22. The packer of claim 19, wherein the first tapered member comprises a shoulder proximal to an inner diameter of the first tapered member, and wherein the first sealing element comprises a shoulder proximal to an inner diameter of the first sealing element, the shoulder of the first tapered member engaging the shoulder of the first sealing element in the first configuration.

* * * * *